US008210813B2

(12) United States Patent
Wilson

(10) Patent No.: US 8,210,813 B2
(45) Date of Patent: Jul. 3, 2012

(54) METHOD AND APPARATUS FOR TURBINE ENGINES

(75) Inventor: Ian David Wilson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 768 days.

(21) Appl. No.: 12/437,074

(22) Filed: May 7, 2009

(65) Prior Publication Data

US 2010/0284799 A1 Nov. 11, 2010

(51) Int. Cl.
*F01D 5/18* (2006.01)

(52) U.S. Cl. ..... 416/96 R; 416/97 R

(58) Field of Classification Search ..... 416/95, 416/96 R, 96 A, 97 R; 415/115, 116
See application file for complete search history.

(56) References Cited

U.S. PATENT DOCUMENTS

| | | | | |
|---|---|---|---|---|
| 5,318,404 | A * | 6/1994 | Carreno et al. | 416/96 R |
| 5,350,277 | A * | 9/1994 | Jacala et al. | 416/90 R |
| 7,207,775 | B2 | 4/2007 | Muriithi | |
| 8,047,773 | B2 * | 11/2011 | Bruce et al. | 415/173.3 |
| 2001/0019696 | A1 | 9/2001 | Jones | |
| 2001/0048878 | A1 * | 12/2001 | Willett et al. | 416/97 R |
| 2010/0178159 | A1 * | 7/2010 | Bulgrin et al. | 415/170.1 |
| 2011/0085892 | A1 * | 4/2011 | John et al. | 415/171.1 |

* cited by examiner

*Primary Examiner* — Gary F. Paumen
(74) *Attorney, Agent, or Firm* — Armstrong Teasdale LLP

(57) ABSTRACT

A method for sealing a gas turbine engine includes coupling a turbine bucket to a rotor wheel and forming an interface region therebetween. A cooling air passage is defined in a portion of the rotor wheel and a cooling air manifold is defined in a portion of the turbine bucket. The method also includes inserting a seal tube within at least a portion of the cooling air passage. The method further includes coupling the cooling air passage, the seal tube, and the cooling air manifold in flow communication to at least partially define a turbine bucket cooling system. The method also includes operating the gas turbine engine such that the rotor wheel and the turbine bucket are rotated, thereby inducing a pressure on the seal tube to substantially decrease air flow discharged from the turbine bucket cooling system through the interface region.

20 Claims, 5 Drawing Sheets

METHOD AND APPARATUS FOR TURBINE ENGINES

BACKGROUND OF THE INVENTION

The embodiments described herein relate generally to gas turbine engines and, more particularly, to methods and apparatus for sealing within gas turbine engines.

At least some known gas turbine engines include a plurality of rotating turbine blades or buckets that channel high-temperature combustion gases stream through the gas turbine engines. Known buckets are typically coupled to a rotor within the gas turbine engine. Thermal energy within the combustion gases is converted to rotational kinetic energy by the buckets, which transfer rotational energy from the buckets to the rotor. At least some of these known buckets may be subjected to high temperature environments, and cooling of such buckets may extend their useful life. Specifically, to control an operating temperature of the buckets, at least some known gas turbine engines channel cooling air towards the buckets via an air-cooling system. More specifically, in at least some known gas turbine engines, compressor bleed air is channeled into at least one air channel defined within the rotor and subsequently to the buckets via a plurality of channels extending from the rotor air channels. As the cooling air flows through the buckets, the buckets are cooled, and spent cooling air is then discharged from the buckets into the combustion gas stream.

At least some of the known bucket air-cooling systems into a cavity defined between the buckets and the rotor. More specifically, such cavities are at least partially defined by a dovetail slot on the rotor and an underside portion of a circumferential row of buckets. Such cavities are at least partially sealed by surface contact between a bucket dovetail surface and a rotor dovetail surface. At least a portion of such cavities are also sealed by spraying substances that include materials, for example, aluminum, onto the bucket and/or rotor dovetail surfaces. Other designs for sealing the air supply cavities include uniquely-shaped C-seals, end plates, and/or cover plates that span multiple buckets.

Within at least some known cavities, a portion of the cooling air leaks from the cavity via unsealed portions of the bucket and/or rotor dovetail surfaces into rotor-stator purge cavities, that are in communication with the combustion gas stream, prior to the air being channeled into the buckets. Because the cooling air is supplied by the compressor, such leakage may reduce the efficiency of the gas turbine engine and may cause a size of the compressor to be increased. Such size increases typically increase capital and operational costs.

BRIEF DESCRIPTION OF THE INVENTION

This Brief Description is provided to introduce a selection of concepts in a simplified form that are further described below in the Detailed Description. This Brief Description is not intended to identify key features or essential features of the claimed subject matter, nor is it intended to be used as an aid in determining the scope of the claimed subject matter.

In one aspect, a method for sealing a gas turbine engine is provided. The method includes coupling a turbine bucket to a rotor wheel and forming an interface region therebetween. A cooling air passage is defined in a portion of the rotor wheel and a cooling air manifold is defined in a portion of the turbine bucket. The method also includes inserting a seal tube within at least a portion of the cooling air passage. The method further includes coupling the cooling air passage, the seal tube, and the cooling air manifold in flow communication to at least partially define a turbine bucket cooling system. The method also includes operating the gas turbine engine such that the rotor wheel and the turbine bucket are rotated, thereby inducing a pressure on the seal tube to substantially decrease air flow discharged from the turbine bucket cooling system through the interface region.

In another aspect, a turbine bucket cooling system for use with a turbine bucket is provided. The system includes a cooling air passage defined in a portion of a rotor wheel. The system also includes a cooling air manifold defined in a portion of a turbine bucket. The cooling air manifold is coupled in flow communication with the cooling air passage. The system further includes a seal tube assembly extending through the at least a portion of the rotor wheel and extending to the at least a portion of the turbine bucket.

In another aspect, a gas turbine engine is provided. The gas turbine engine includes a turbine section including at least one turbine bucket coupled to a portion of a rotor wheel. The engine also includes a compressor section coupled in flow communication with the turbine section via a cooling air flow path. The cooling air flow path includes at least a portion of a turbine bucket cooling system coupled in flow communication with the cooling air flow path. The turbine bucket cooling system includes a cooling air passage defined in the portion of the rotor wheel. The system also includes a cooling air manifold defined in a portion of the turbine bucket. The cooling air manifold is coupled in flow communication with the cooling air passage. The system further includes a seal tube assembly extending through the portion of the rotor wheel and extending to the portion of the turbine bucket.

BRIEF DESCRIPTION OF THE DRAWINGS

The embodiments described herein may be better understood by referring to the following description in conjunction with the accompanying drawings.

DETAILED DESCRIPTION OF THE INVENTION

Figure 1:
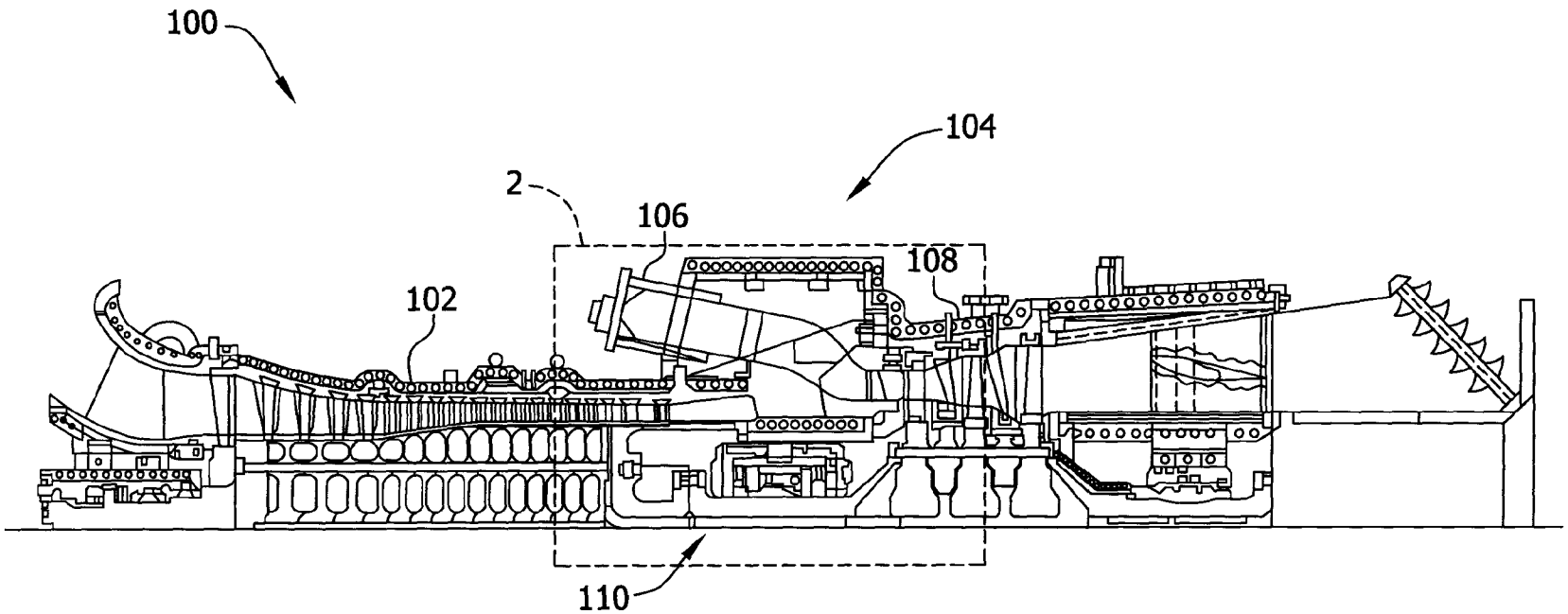
FIG. 1 is a schematic diagram of an exemplary gas turbine engine.

FIG. 1 is a schematic illustration of an exemplary gas turbine engine 100. Engine 100 includes a compressor 102 and a plurality of combustors 104. Each combustor 104 includes a fuel nozzle assembly 106. In the exemplary embodiment, engine 100 also includes a turbine 108 and a common compressor/turbine rotor 110 (sometimes referred to as rotor 110). In one embodiment, engine 100 is a MS9001E engine, sometimes referred to as a 9E engine, commercially available from General Electric Company, Greenville, S.C.

Figure 2:
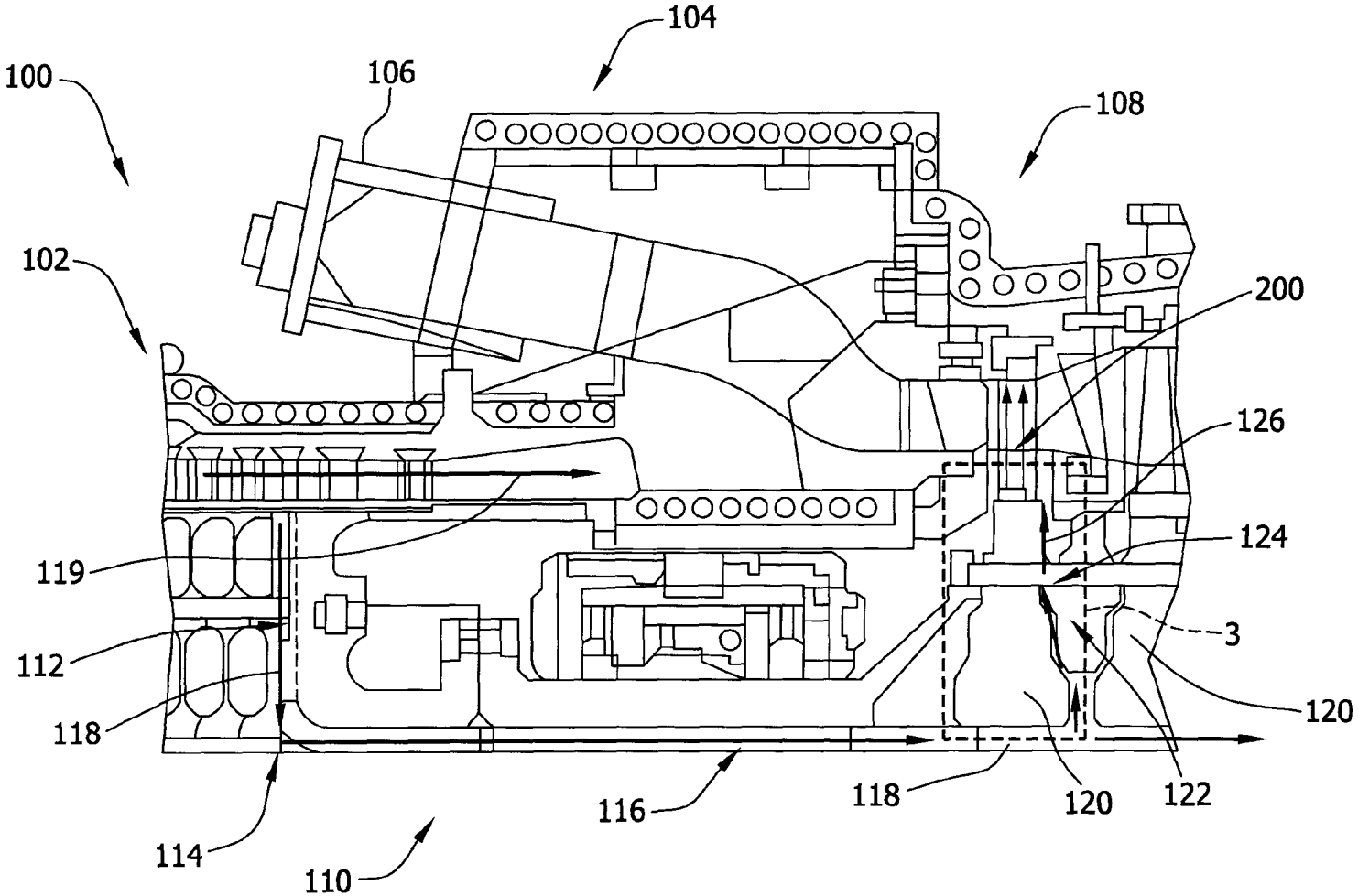
FIG. 2 is enlarged cross-sectional view of a portion of the gas turbine engine shown in FIG. 1 and taken along area 2.

FIG. 2 is enlarged cross-sectional view of a portion of gas turbine engine 100 and taken along area 2 (shown in FIG. 1). Compressor 102 defines a first portion 112 of a cooling air flow path 114 that extends between compressor 102 and turbine 108. Rotor 110 defines a second portion 116 of cooling air flow path 114. Second portion 116 extends in flow communication from first portion 112. In the exemplary embodiment, a cooling air stream 118 is channeled away from a compressed air stream 119 towards turbine 108. Moreover, in the exemplary embodiment, a plurality of rotor wheels 120 is coupled to rotor 110 within turbine 108. Each rotor wheel 120 is axially separated from an adjacent rotor wheel 120 by a spacer bore 122. Each spacer bore 122 and one rotor wheel 120 defines in combination a third portion 124 of cooling air flow path 114 that extends in flow communication from second portion 116. A cooling air stream portion 126 is channeled away from second portion 116 of cooling air flow path 114 via third portion 124. Cooling air flow path 114 also includes a turbine bucket cooling system 200 that is coupled in flow communication with third portion 124 of cooling air flow path 114.

In operation, compressor 102 is rotated by turbine 108 via rotor 110. Compressor 102 channels a compressed air stream 119 towards combustor 104. Cooling air stream 118 is channeled from compressed air stream 119 towards turbine 108 via cooling air flow path first and second portions 112 and 116, respectfully, of cooling air flow path 114. Cooling air stream portion 126 is channeled away from cooling air stream 118 via cooling air flow path third portion 124 and is channeled towards turbine bucket cooling system 200.

Figure 3:
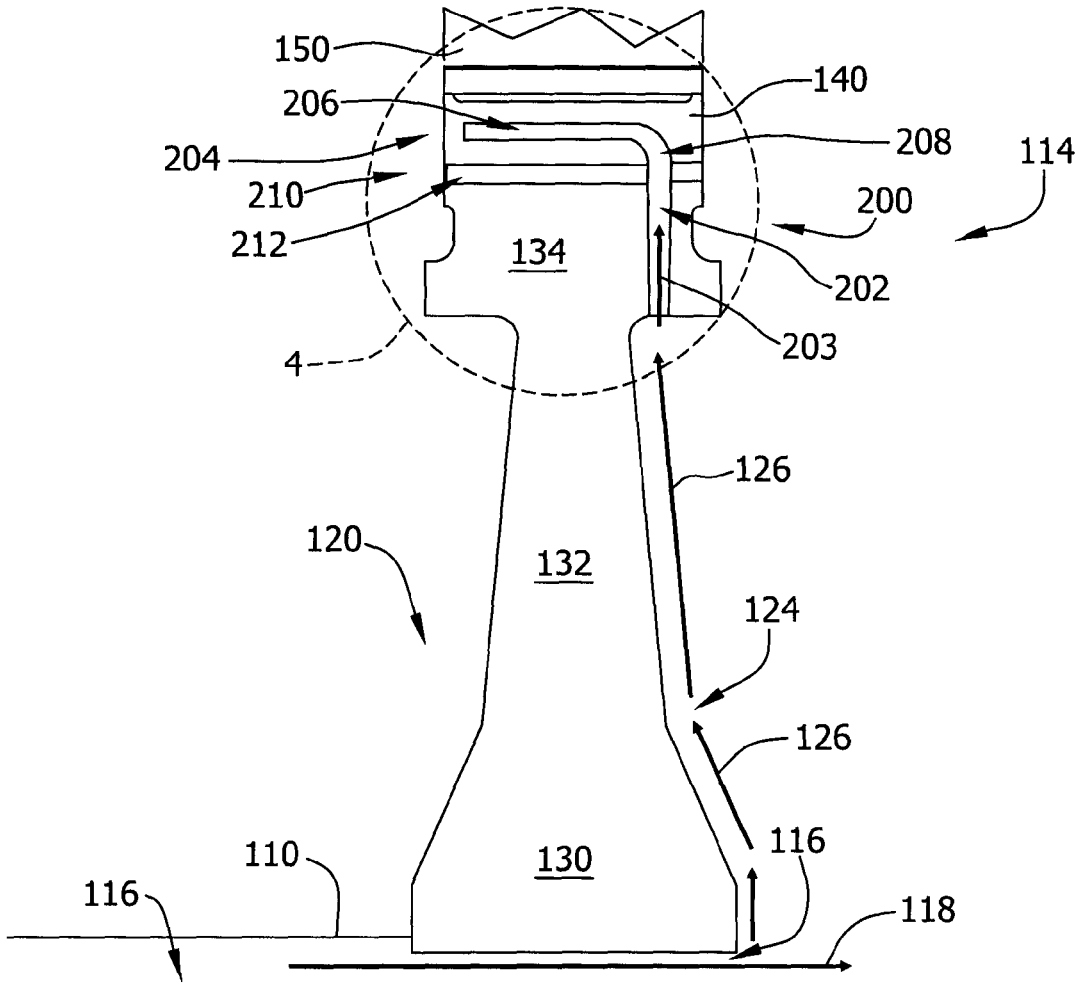
FIG. 3 is a schematic diagram of a portion of a turbine bucket cooling system that may be used with the gas turbine engine shown in FIG. 2.

FIG. 3 is a schematic diagram of a portion of bucket cooling system 200 that may be used with gas turbine engine 100 and taken along area 3 (both shown in FIG. 2). In the exemplary embodiment, rotor wheel 120 is an integral portion of rotor 110 that is fabricated using forging methods. Alternatively, rotor wheel 120 and rotor 110 are fabricated separately and coupled together using any methods that enable bucket cooling system 200 to function as described herein. Rotor wheel 120 includes a hub section 130 and a disc section 132 that is integrally formed with rotor wheel 120 and that is radially outboard of hub section 130. Rotor wheel 120 also includes a turbine bucket attachment or rim section 134 that is formed integrally with rotor wheel 120 and that is radially outboard of disc section 132.

As described above, rotor 110 defines a second portion 116 of cooling air flow path 114. Third portion 124 of cooling air flow path 114 extends in flow communication from second portion 116. Cooling air stream portion 126 is channeled away from second portion 116 via third portion 124 of cooling air flow path 114. Cooling air flow path 114 also includes turbine bucket cooling system 200. Bucket cooling system 200 is in flow communication with third portion 124 of cooling air flow path 114.

In the exemplary embodiment, turbine bucket cooling system 200 is defined within rim section 134 of rotor wheel 120 and within a dovetail section 140 of a turbine bucket 150. Alternatively, turbine bucket cooling system 200 is defined within any portion of turbine engine 100 that enables turbine bucket cooling system 200 to function as described herein. Also, in the exemplary embodiment, turbine bucket cooling system 200 includes a cooling air passage 202 that is defined within rim section 134 by methods that include machining passage 202 within forged rim section 134. Cooling air passage 202 enables a bucket cooling air stream 203 to be channeled into turbine bucket cooling system 200 from cooling air stream portion 126.

Moreover, in the exemplary embodiment, turbine bucket cooling system 200 includes a cooling air manifold 204 that is defined in a portion of turbine bucket 150, and more specifically, within dovetail section 140. Moreover, in the exemplary embodiment, cooling air manifold 204 includes a first or axial portion 206 that extends substantially parallel to an axial centerline (not shown) of turbine engine 100. Alternatively, axial portion 206 of cooling air manifold 204 has any orientation that enables turbine bucket cooling system 200 to function as described herein. Also, in the exemplary embodiment, cooling air manifold 204 includes a second or elbow portion 208 that enables cooling air manifold 204 to couple in communication to cooling air passage 202.

In some embodiments, turbine bucket cooling system 200 is formed in turbine engines 100 that are newly constructed. Alternatively, in some embodiments, turbine bucket cooling system 200 is retrofitted into existing turbine engines 100. Specifically, in some embodiments, dovetail section 140 and rim section 134 form an interface region 210 that defines a cavity 212.

Figure 4:
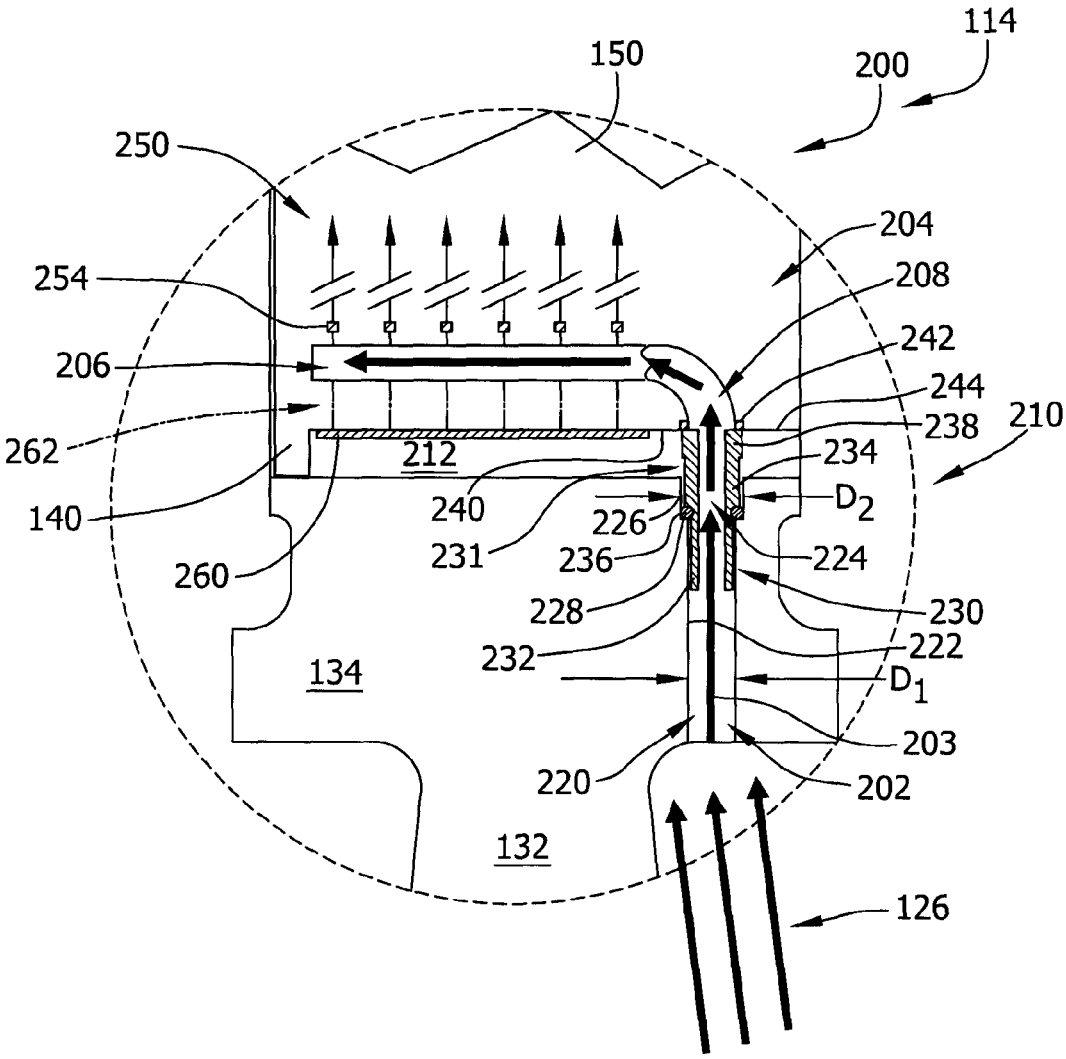
FIG. 4 is an enlarged cross-sectional view of the turbine bucket cooling system shown in FIG. 3 and taken along area 4.

FIG. 4 is an enlarged cross-sectional view of bucket cooling system 200 taken along area 4 (shown in FIG. 3). In the exemplary embodiment, cooling air passage 202 includes a radially inner passage 220 that is defined by a radially inner wall 222. Also, in the exemplary embodiment, radially inner passage 220 is substantially cylindrical and has with a first diameter $D_1$. Alternatively, radially inner passage 222 may have any shape that enables bucket cooling system 200 to function as described herein. Further, in the exemplary embodiment, cooling air passage 202 also includes a radially outer passage 224 that is defined by radially outer wall 226. In the exemplary embodiment, radially outer passage 224 is substantially cylindrical in shape and has a second diameter $D_2$. Alternatively, radially outer passage 224 has any shape that enables bucket cooling system 200 to function as described herein. Second diameter $D_2$ is larger than first diameter $D_1$, wherein radially inner wall 222 and radially outer wall 226 cooperate to define a support ledge 228.

In the exemplary embodiment, turbine bucket cooling system 200 also includes a seal tube assembly 230 that includes a seal tube 231 that is inserted into at least a portion of cooling air passage 202 at interface region 210. Seal tube 231 includes a radially inner section 232 that has a size and a shape that is substantially similar to first diameter $D_1$ and to the shape of radially inner passage 220. As such, seal tube 231 forms a close fit with radially inner passage 220. Radially inner section 232 extends radially inward from support ledge 228 into radially inner passage 220. Seal tube 231 also includes a radially intermediate portion 234 that has a size and a shape that is substantially similar to second diameter $D_2$ and to the shape of radially outer passage 224. As such, seal tube 231 forms a close fit with radially outer passage 224.

Also, in the exemplary embodiment, radially intermediate portion 234 is positioned against at least a portion of support ledge 228, and seal tube assembly 230 includes a first sealing device 236 that is positioned against support ledge 228. First sealing device 236 cooperates with radially intermediate portion 234 and radially outer wall 226 to substantially seal against potential air leakage that may seep from cooling air passage 202 into cavity 212. In the exemplary embodiment, first sealing device 236 is a ring seal. Alternatively, first sealing device 236 may be any type of seal, such as a tube seal that enables turbine bucket cooling system 200 to function as described herein.

Further, in the exemplary embodiment, seal tube 231 also includes a radially outer portion 238 that extends outward from radially intermediate portion 234 to a radially inner surface 240 of dovetail section 140. More specifically, radially outer portion 238 forms a friction fit with radially inner surface 240. Also, in the exemplary embodiment, seal tube assembly 230 includes a second sealing device 242 that is positioned against a radially outer surface 244 of dovetail section 140. Specifically, device 242 is adjacent to a location where seal tube 231 contacts radially inner surface 240 of dovetail section 140. Second sealing device 242 cooperates with radially outer portion 238 and radially outer surface 244 to substantially seal and prevent flow seepage into cavity 212. In the exemplary embodiment, second sealing device 242 may be any type of seal, such as a ring seal that enables seal tube assembly 230 and turbine bucket cooling system 200 to function as described herein. In the exemplary embodiment, centrifugal forces associated with rotation of rotor 110 (shown in FIGS. 1, 2, and 3) and acting on seal tube 238 induce pressure forces that facilitate a sealing action of second sealing device 242.

Seal tube 231 extends across cavity 212 and enables cooling air passage 202 to be coupled with cooling air manifold 204. Seal tube 231 is at least partially supported in place by a close fit with radially inner surface 222 and radially outer surface 226. Further, in the exemplary embodiment, seal tube 231 has a substantially cylindrical shape that facilitates reducing leakage past tube 231, while increasing air flow through seal tube 231.

Also, in the exemplary embodiment, turbine bucket cooling system 200 includes a plurality of air supply capillaries 250 that are coupled in flow communication with axial portion 206 of cooling air manifold 202. Capillaries 250 extend through portions of turbine bucket 150. At least one flow metering device 254 is positioned within each capillary 250 to facilitate enabling a predetermined cooling air flow to be channeled to each turbine bucket 150. During retrofits of existing turbine engines 100, a plate 260 may be coupled, i.e., brazed to radially inner surface 240 of dovetail section 140 to facilitate prevention of flow communication between axial portion 206 of cooling air manifold 202 and cavity 212 via radially inner portions 262 of capillaries 250 that are abandoned in place.

Figure 5:
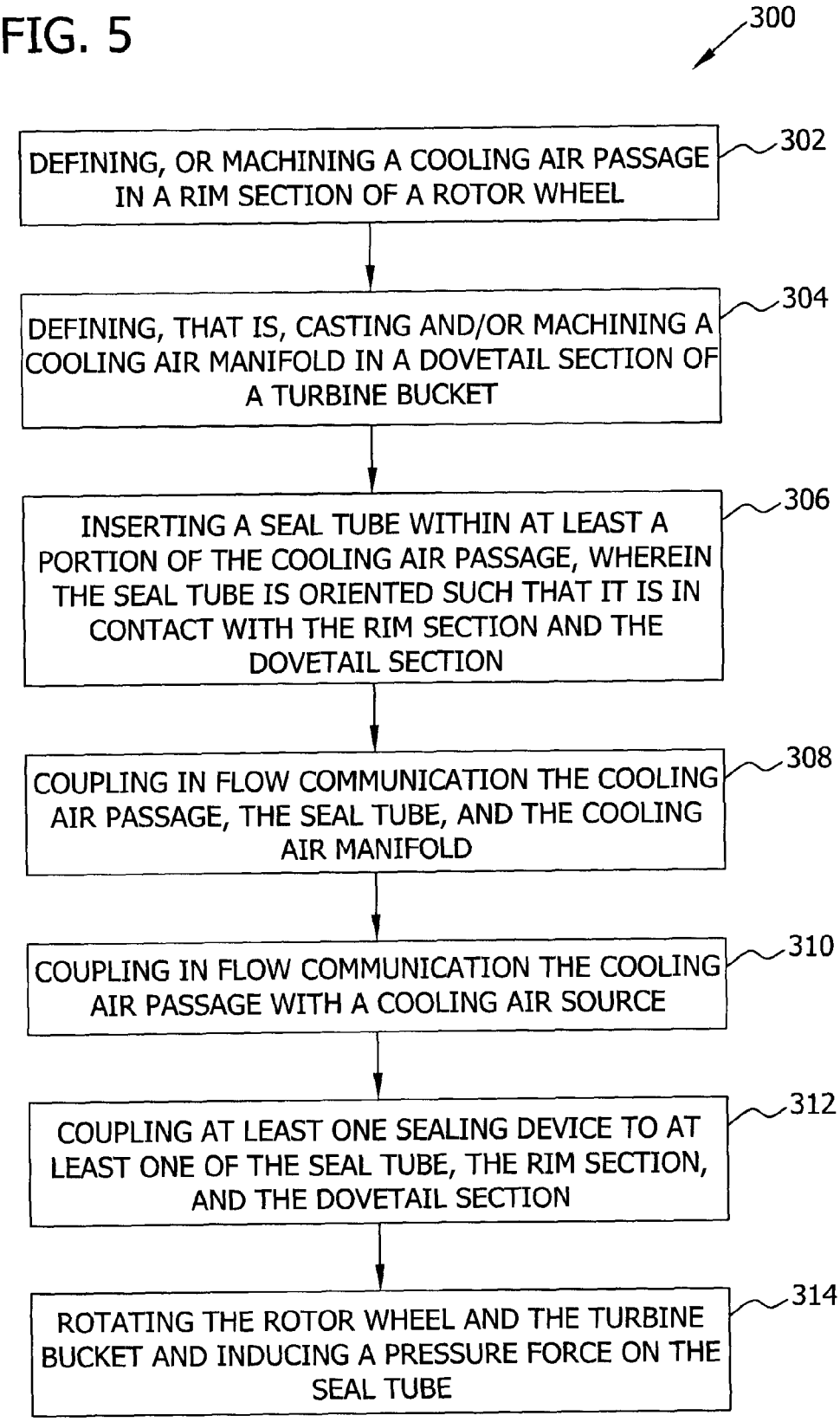
FIG. 5 is a flow chart of an exemplary method of assembling the gas turbine engine shown in FIG. 1.

FIG. 5 is a flow chart of an exemplary method 300 of sealing gas turbine engine 100 (shown in FIG. 1). In the exemplary embodiment, cooling air passage 202 (shown in FIG. 4) is defined 302, i.e., machined, in a portion of rotor wheel 120 (shown in FIG. 3), such as rotor wheel rim section 134 (shown in FIG. 4). Cooling air manifold 204 (shown in FIG. 4) is then defined 304, i.e., cast and/or machined, in a portion of turbine bucket 150 (shown in FIG. 4). Seal tube 231 (shown in FIG. 4) is inserted 306 within at least a portion of cooling air passage 202, such that seal tube 231 is oriented to contact at least a portion of turbine bucket attachment, or rotor wheel rim section 134 and at least a portion of dovetail section 140. Cooling air passage 202, seal tube 231, and cooling air manifold 204 are coupled 308 in flow communication together as a result of coupling turbine bucket 150 to rotor wheel rim section 134, thereby at least partially defining turbine bucket cooling system 200 (shown in FIGS. 2, 3, and 4), including forming interface region 210 (shown in FIGS. 3 and 4). Cooling air passage 202 is coupled 310 in flow communication with a cooling air source, such as, cooling air stream portion 126 and/or compressor 102. At least one sealing device 236 and/or 242 (both shown in FIG. 4) is coupled 312 to at least one of seal tube 231, rim section 134, and/or dovetail section 140. Rotor 110 (shown in FIGS. 1 and 2), including rim section 134 and dovetail section 140, both coupled together, is rotated 314 to induce centrifugal forces acting on seal tube 238, such centrifugal forces subsequently inducing pressure forces that facilitate a sealing action of second sealing device 242, thereby substantially decreasing air flow discharged from turbine bucket cooling system 200 through interface region 210.

Described herein are exemplary embodiments of methods and apparatus that facilitate sealing a gas turbine engine. Specifically, a seal tube assembly, embedded within a turbine bucket cooling system, both as described herein, facilitates channeling sufficient cooling air flow to turbine buckets while reducing cooling air leakage from the associated cooling air streams to such turbine buckets. Specifically, selecting cylindrical and circular shapes for the sealing components of the seal tube assembly as described herein facilitates reducing lengths of sealing surfaces wherein potential air leakage may be experienced while facilitating a proportionate larger air flow surface area than most other geometries. Also, specifically, the use of centrifugal forces associated with rotation of the gas turbine engine acting on the seal tube induce pressure forces that facilitate a sealing action of the seal tube assembly.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assembly packages and methods.

While the invention has been described in terms of various specific embodiments, those skilled in the art will recognize that the invention can be practiced with modification within the spirit and scope of the claims.

What is claimed is:

1. A method for sealing a gas turbine engine, said method comprising:

coupling a turbine bucket to a rotor wheel and forming an interface region therebetween, wherein a cooling air passage is defined in a portion of the rotor wheel and a cooling air manifold is defined in a portion of the turbine bucket;

inserting a seal tube within at least a portion of the cooling air passage;

coupling the cooling air passage, the seal tube, and the cooling air manifold in flow communication to at least partially define a turbine bucket cooling system; and operating the gas turbine engine such that the rotor wheel and the turbine bucket are rotated, thereby inducing a pressure on the seal tube to substantially decrease air flow discharged from the turbine bucket cooling system through the interface region.

2. A method in accordance with claim 1 further comprising coupling the cooling air passage in flow communication with a cooling air source.

3. A method in accordance with claim 2, wherein coupling the cooling air passage in flow communication with a cooling air source comprises coupling the cooling air passage in flow communication with a compressor.

4. A method in accordance with claim 1, wherein defining a cooling air passage in the portion of the rotor wheel comprises machining the cooling air passage in a turbine bucket attachment section of the rotor wheel.

5. A method in accordance with claim 1, wherein defining a cooling air manifold in the portion of the turbine bucket comprises defining the cooling air manifold in a rotor wheel attachment section of the turbine bucket.

6. A method in accordance with claim 1, wherein inserting a seal tube within at least a portion of the cooling air passage comprises orienting the seal tube to contact at least a portion of a turbine bucket attachment section of the rotor wheel and at least a portion of a rotor wheel attachment section of the turbine bucket.

7. A method in accordance with claim 6 further comprising coupling at least one sealing device to at least one of the seal tube to the turbine bucket attachment section of the rotor wheel, and to the rotor wheel attachment section.

8. A turbine bucket cooling system for use with a turbine bucket, said turbine bucket cooling system comprising:

a cooling air passage defined in a portion of a rotor wheel;

a cooling air manifold defined in a portion of a turbine bucket, said cooling air manifold coupled in flow communication with said cooling air passage; and a seal tube assembly extending through said at least a portion of the rotor wheel and extending to said at least a portion of the turbine bucket.

9. A turbine bucket cooling system in accordance with claim 8, wherein at least a portion of said seal tube assembly is inserted into at least a portion of a cooling air passage defined within a rim section.

10. A turbine bucket cooling system in accordance with claim 9 further comprising said cooling air manifold defined within a dovetail section, said cooling air manifold coupled in flow communication with said seal tube assembly.

11. A turbine bucket cooling system in accordance with claim 10, wherein said seal tube assembly extends between said cooling air passage and said cooling air manifold.

12. A turbine bucket cooling system in accordance with claim 8, wherein said seal tube assembly comprises at least one sealing device coupled to a seal tube and coupled to at least one of a dovetail section and a rim section.

13. A turbine bucket cooling system in accordance with claim 8 further comprising a plate coupled to at least a portion of a dovetail section.

14. A turbine bucket cooling system in accordance with claim 8 further comprising at least one flow control device inserted into at least one bucket cooling passage.

15. A gas turbine engine comprising:

a turbine section comprising at least one turbine bucket coupled to a portion of a rotor wheel;

a compressor section coupled in flow communication with said turbine section via a cooling air flow path that comprises at least a portion of a turbine bucket cooling system coupled in flow communication with said cooling air flow path, said turbine bucket cooling system comprising:

a cooling air passage defined in said portion of said rotor wheel;

a cooling air manifold defined in a portion of said turbine bucket, said cooling air manifold coupled in flow communication with said cooling air passage; and a seal tube assembly extending through said portion of said rotor wheel and extending to said portion of said turbine bucket.

16. A gas turbine engine in accordance with claim 15, wherein at least a portion of said at least one turbine bucket comprises a dovetail section, wherein said cooling air manifold is defined within said dovetail section.

17. A gas turbine engine in accordance with claim 15, wherein at least a portion of said rotor wheel comprises a rim section, wherein a cooling air passage is defined within said rim section.

18. A gas turbine engine in accordance with claim 15, wherein at least a portion of said seal tube is inserted into at least a portion of a cooling air passage defined within and extending through a rim section.

19. A gas turbine engine in accordance with claim 15, wherein at least a portion of said seal tube is inserted into at least a portion of a cooling air passage defined within and extending through a rim section.

20. A gas turbine engine in accordance with claim 15 further comprising at least one sealing device coupled to said seal tube and coupled to at least one of said at least one turbine bucket and said rotor wheel.

* * * * *